US006099393A

United States Patent [19]

Katagiri et al.

[11] Patent Number: 6,099,393

[45] Date of Patent: Aug. 8, 2000

[54] POLISHING METHOD FOR SEMICONDUCTORS AND APPARATUS THEREFOR

[75] Inventors: Soichi Katagiri, Kodaira; Shigeo Moriyama, Tama; Kan Yasui, Kokubunji; Katsuhiko Yamaguchi, Hachioji, all of Japan

[73] Assignee: Hitachi, Ltd., Tokyo, Japan

[21] Appl. No.: 09/080,728

[22] Filed: May 21, 1998

[30] Foreign Application Priority Data

May 30, 1997 [JP] Japan ..... 9-156135

[51] Int. Cl.[7] ..... B24B 1/00

[52] U.S. Cl. ..... 451/56; 451/60; 451/444

[58] Field of Search ..... 451/60, 288, 443, 451/444, 446

[56] References Cited

U.S. PATENT DOCUMENTS

| | | | |
|---|---|---|---|
| 5,421,768 | 6/1995 | Fujiwara et al. | 451/283 |
| 5,643,067 | 7/1997 | Katsuoka et al. | 451/444 |
| 5,725,417 | 3/1998 | Robinson | 451/56 |
| 5,782,675 | 7/1998 | Southwick | 451/56 |
| 5,860,847 | 1/1999 | Sakurai et al. | 451/10 |
| 5,885,137 | 3/1999 | Ploessl | 451/56 |
| 5,916,010 | 6/1999 | Varian et al. | 451/38 |

FOREIGN PATENT DOCUMENTS 8294861 12/1996 Japan .

OTHER PUBLICATIONS

International Publication No. WO97/10613 published Mar. 20, 1997.

*Primary Examiner*—Timothy V. Eley
*Assistant Examiner*—Dung Van Nguyen
*Attorney, Agent, or Firm*—Antonelli, Terry, Stout & Kraus, LLP

[57] ABSTRACT

In the polishing machine 10 for pressing the polished surface 7 of the workpiece 1 against the face where there are abrasives 15 of the rotating polishing tool 11 and executing chemical mechanical polishing, the brushing device 30, the cleaner 40, the abrasive supplier 52, and the pure water supplier 60 are sequentially arranged behind the location of the head 20 for pressing the workpiece 1 against the polishing tool 11 in the rotational direction. The cleaner 40 sprays the cleaning water 47 to the face where there are abrasives 15 of the rotating polishing tool 11 and sucks and collects it by the vacuum hole 45. Fresh slurry 62 is always supplied by the slurry supplier 63 comprising the abrasive supplier 52 and the pure water supplier 60.

22 Claims, 6 Drawing Sheets

POLISHING METHOD FOR SEMICONDUCTORS AND APPARATUS THEREFOR

BACKGROUND OF THE INVENTION

[0001]

The present invention relates to a polishing art, particularly to a CMP (chemical mechanical polishing) art and for example, an art which is effective in using for chemically and mechanically polishing the patterned surface of a patterned semiconductor wafer (hereafter referred to as a wafer).

[0002]

Recently, a method for manufacturing a semiconductor apparatus for flattening concave and convex parts of the patterned surface of a patterned wafer by the chemical mechanical polishing method has been proposed. The art for flattening concave and convex parts of the patterned surface of a patterned wafer by the chemical mechanical polishing method polishes the patterned wafer by rubbing it against a polishing tool, so that the concave and convex parts of the patterned surface of the wafer can be flattened promptly and precisely.

[0003]

The chemical mechanical polishing machine executing the chemical mechanical polishing method used for flattening includes a polishing tool pasted on the rotary table formed in a disk shape, a head rotating on its axis in the state of holding a patterned wafer, and a slurry supplier for supplying a polishing lubricant which is called slurry in which fine abrasives are suspended in pure water to the polishing tool and is structured so as to drop slurry on the polishing surface of the polishing tool and then perform chemical mechanical polishing by pressing the polished surface of the patterned wafer held by the head rotating on its axis against the polishing surface of the rotating polishing tool.

[0004]

However, in the chemical mechanical polishing method, there are many foreign substances on the polishing surface of a polishing tool such as clustered particles of abrasives included in the slurry, broken pieces caused by a wafer crushed during polishing, and dust, and these foreign substances cannot be fully removed from the polishing surface only by rinsing slurry and remain on the polishing surface. The polished surface of the patterned wafer is damaged by foreign substances remaining on the polishing surface and hence the base pattern is damaged, so that reliable chemical mechanical polishing cannot be executed stably.

[0005]

As a means for solving this problem of the chemical mechanical polishing method, the following polishing machine is proposed in Japanese Patent Application Laid-Open 8-294861. Namely, the polishing machine has a liquid drain mechanism for removing polishing waste liquid from the polishing surface during polishing backward in the rotational direction in the patterned wafer rubbing area of the polishing tool and is structured so as to forcibly drain slurry waste liquid used for polishing once by the liquid drain mechanism.

[0006]

However, it is made clear by the inventor of the present invention that in the aforementioned polishing machine, particles with comparatively large diameters such as several μm or more and particles caused by chipping of a grindstone generated when a fixed abrasive is used as a polishing tool instead of polishing cloth cannot be removed fully, so that there is a problem imposed that reliable chemical mechanical polishing cannot be executed stably. The polishing art using the aforementioned fixed abrasive is disclosed in International Patent Publication WO97/10613.

[0007]

As slurry, fine abrasives with diameters from several tens μm to sub μm such as silicon oxide and cerium oxide are used, so that slurry is a very expensive material. On the other hand, slurry is rinsed, so that almost all slurry is drained without contributing to chemical mechanical polishing. Therefore, when very expensive slurry is rinsed and forcibly drained without contributing to polishing, not only the running cost of the polishing machine will increase and the cost of the flattening step of patterned wafers but also the cost of the whole manufacturing method of a semiconductor apparatus will increase.

SUMMARY OF THE INVENTION

[0008]

An object of the present invention is to provide a polishing art for suppressing increasing of the cost and stably executing reliable processing.

[0010]

The outline of the typical one among the inventions disclosed in this patent application will be explained hereunder.

[0011]

Namely, it is a polishing machine for pressing and polishing the polished surface of a workpiece against the face where there are abrasives of a rotating polishing tool and a cleaner for spraying cleaning water to the face where there are abrasive of the polishing tool and also sucking and collecting it by the vacuum hole is arranged behind the location where the workpiece is pressed against the polishing tool in the rotational direction.

[0012]

By the aforementioned means, clustered particles and foreign substances generated by polishing can be fully removed by the cleaner, so that generation of defects of the polished surface of a workpiece caused by these clustered particles and foreign substances can be prevented and as a result, an occurrence of damage of the base pattern due to the defects can be prevented. Namely, reliable chemical mechanical polishing can be executed stably.

[0059]

According to the present invention, by installing a cleaner behind the head of a polishing tool by which chemical mechanical polishing is executed in the rotational direction, clustered particles and foreign substances generated by chemical mechanical polishing can be fully removed by the cleaner, so that generation of defects of the polished surface of a workpiece caused by these clustered particles and foreign substances can be prevented and as a result, an occurrence of damage of the base pattern due to the defects can be prevented. Namely, reliable chemical mechanical polishing can be executed stably.

[0060]

Furthermore, since expensive slurry is collected by the cleaner, it can be reused and hence the cost can be reduced.

[0009]

The foregoing and other objects and features of the present invention will be understood from the following detailed description of embodiments in connection with the accompanying drawings.

BRIEF DESCRIPTION OF THE DRAWINGS

FIG. 1A is a perspective view and FIG. 1B is a development elevation.

DETAILED DESCRIPTION OF THE PREFERRED EMBODIMENTS

[0013]

Figure 1A:
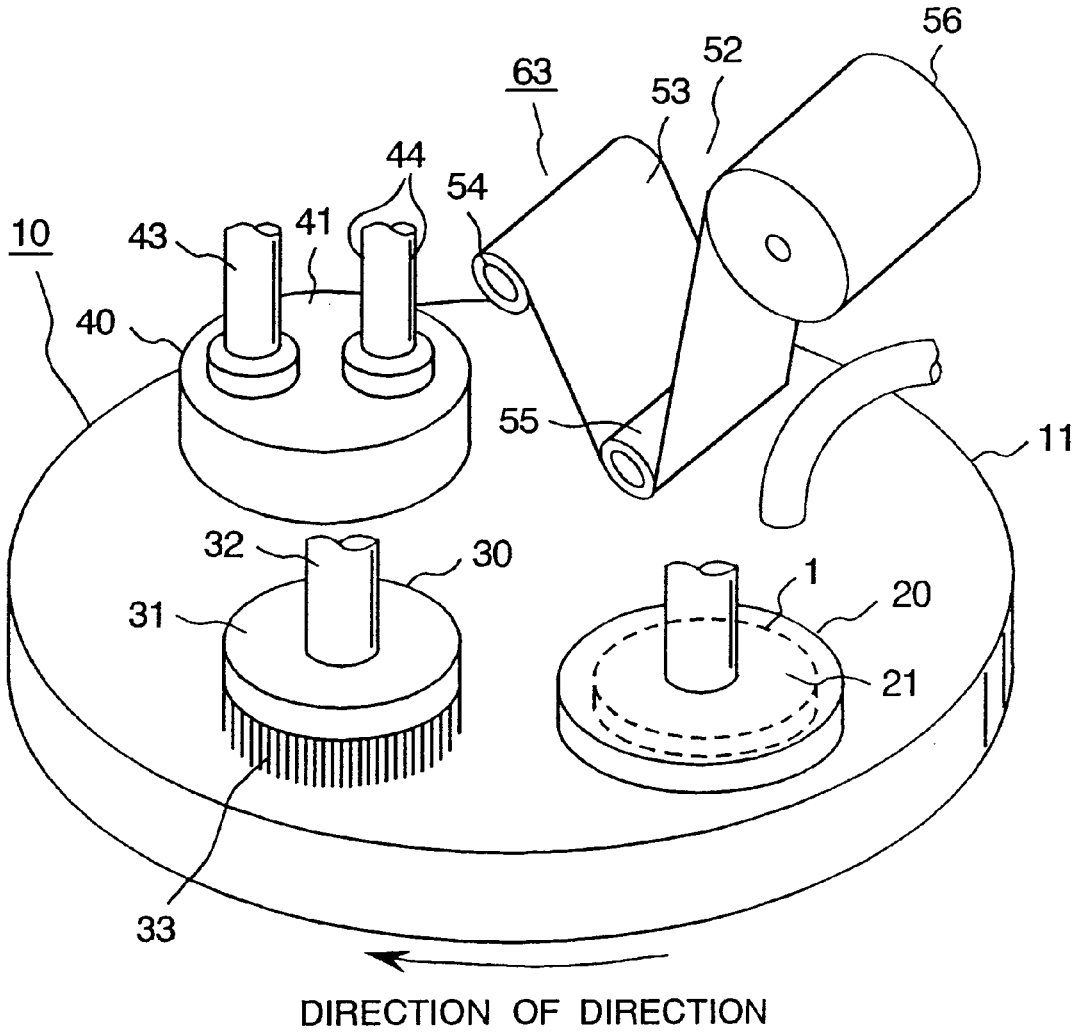
FIGS. 1A and 1B show a polishing machine which is an embodiment of the present invention.
Figure 1B:
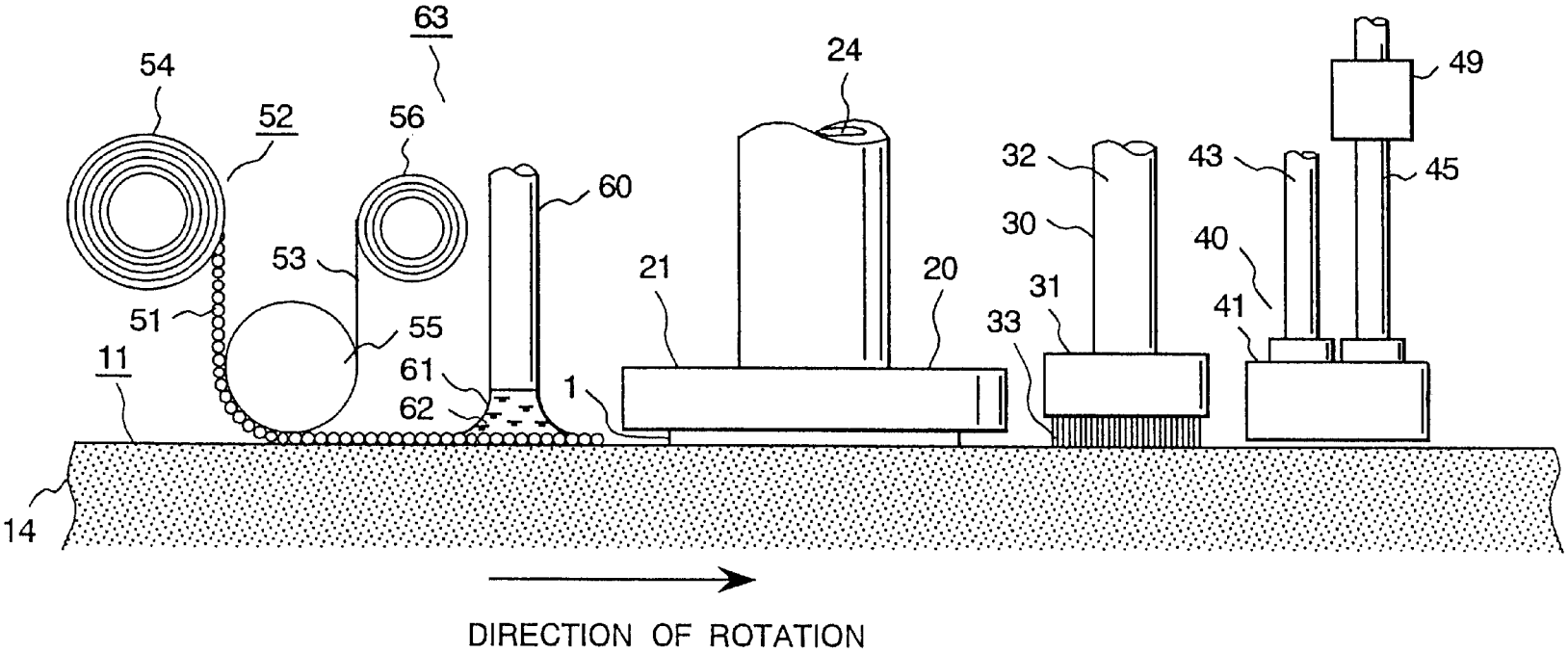
Figure 2:
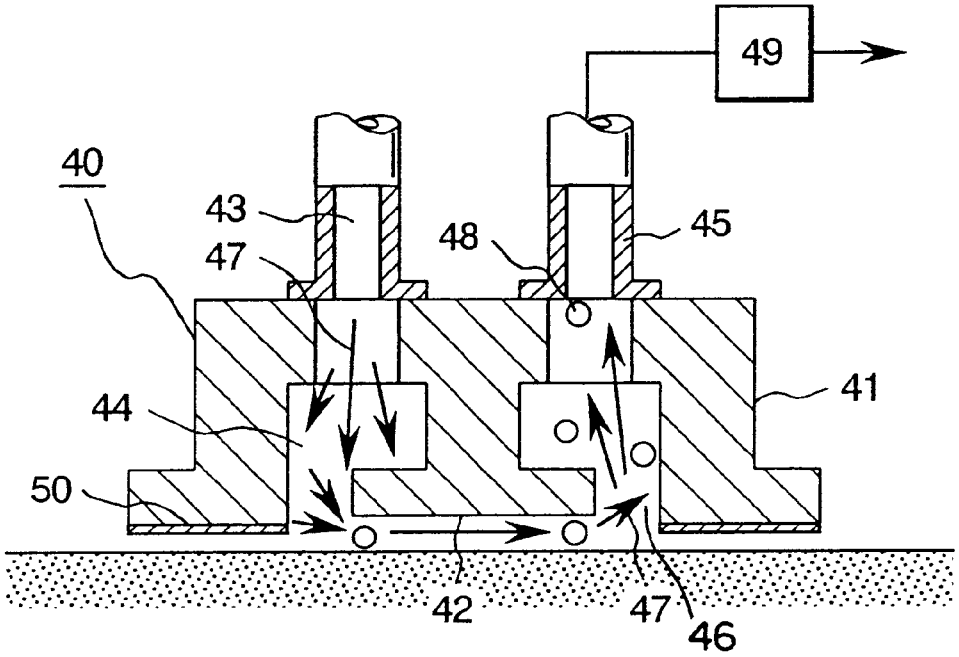
FIG. 2 is an enlarged cross sectional view of a cleaner.
Figure 3:
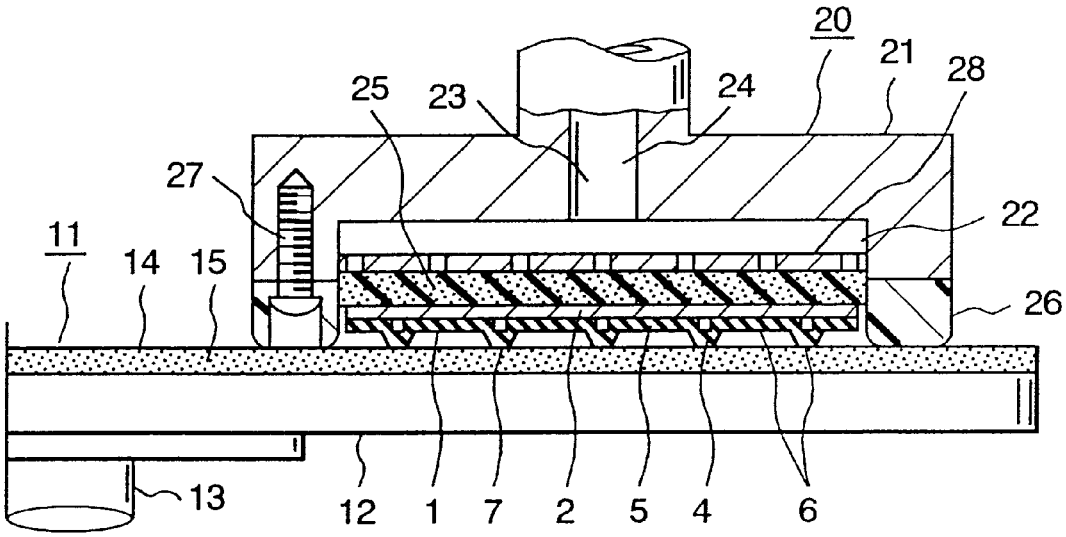
FIG. 3 is a front cross sectional view of a head.
Figure 4:
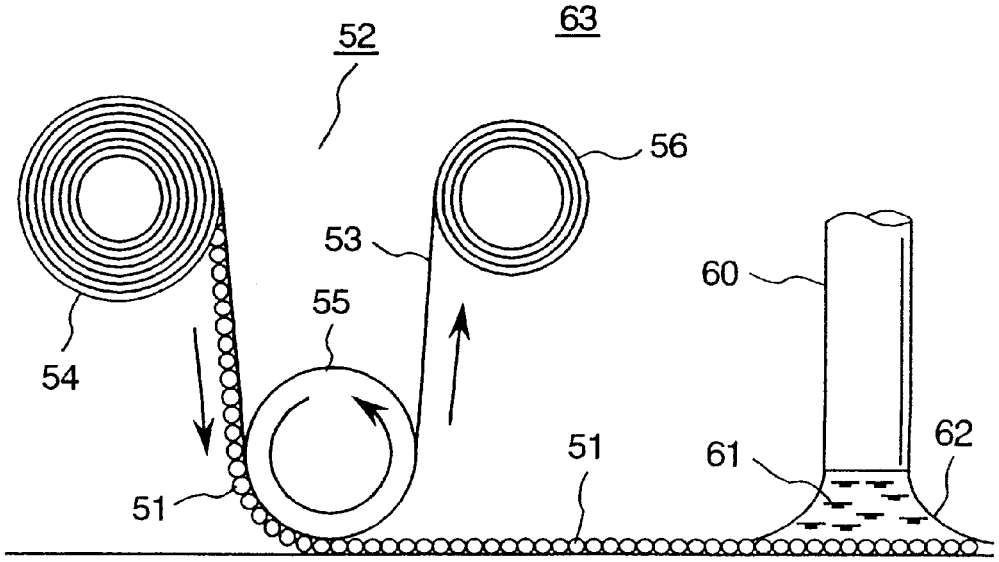
FIG. 4 is a front cross sectional view showing a slurry supplier
Figure 5:
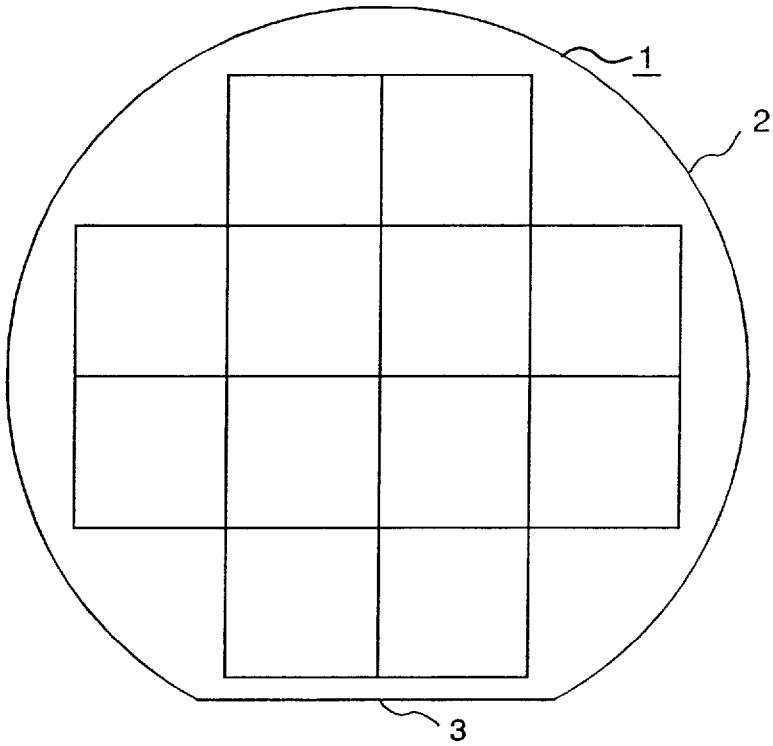
FIG. 5 is a plan view of a workpiece.

FIG. 1A and 1B show a polishing machine which is an embodiment of the present invention, and FIG. 1A is a perspective view thereof, and FIG. 1B is a development elevation thereof. FIGS. 2 to 4 show major portions respectively, and FIG. 2 is a cross sectional view of a cleaner, and FIG. 3 is a front cross sectional view of a head, and FIG. 4 is a front cross sectional view showing a slurry supplier. FIG. 5 and the subsequent drawings are illustrations for the polishing method which is an embodiment of the present invention.

[0014]

In this embodiment, the polishing machine of the present invention is structured as a patterned wafer polishing machine (hereinafter referred to as a polishing machine) used in the manufacturing method of a semiconductor apparatus. Next, a patterned wafer (hereinafter referred to as a workpiece) 1 shown in FIG. 5 which is an object of the manufacturing method of a semiconductor apparatus and a workpiece of a polishing machine 10 will be explained briefly.

[0015]

The workpiece 1 shown in FIG. 5 has a wafer 2 in which an orientation flat 3 is cut in a straight line at a part of the periphery thereof. As clearly shown in the cross sectional view in FIG. 6, in the surface layer area on the patterned surface (hereinafter referred to as the top surface) of the wafer 2, a memory M which is an example of a semiconductor device is formed and on the surface, an interconnection 4 formed from an interconnection layer film which is an example of a metal film and an inter-layer-dielectric film 5 which is an example of a dielectric film are deposited respectively. The interconnection 4 is formed by line segments having a thickness, so that on the top surface of the inter-layer-dielectric film 5 deposited on it, concave and convex parts 6 are formed according to the concave and convex of the underlying layer of the interconnection 4. Therefore, in this embodiment, a part of the top surface of the interlayer-dielectric film 5 is removed by chemical mechanical polishing by the polishing machine 10, so that the inter-layer-dielectric film 5 is flattened. Therefore, the top surface of the inter-layer-dielectric film 5 forms a polished surface 7 which is polished by the polishing machine 10.

[0016]

The polishing machine 10 will be explained in detail by referring to FIGS. 1 to 4. The polishing machine 10 in this embodiment has a polishing tool 11 and a head 20. As shown in FIG. 3, the polishing tool 11 has a base plate 12 formed in a disk shape having a diameter sufficiently larger than the diameter of the workpiece 1 and the base plate 12 is supported so as to freely rotate in a horizontal surface. At the center of the bottom surface of the base plate 12, a rotational axis 13 vertically arranged is fixed and the base plate 12 is structured so as to be driven to rotate by the rotational axis 13. Polishing cloth 14 is uniformly pasted overall the top surface of the base plate 12. The polishing cloth 14 is an abradant in which fine abrasives such as colloidal silica are held in plastic cloth having a pore structure on its surface and a face where there are abrasives 15 is formed by the top surface. In the polishing operation by the polishing cloth 14, use of slurry provides a state that in addition to mechanical polishing, mechanochemical polishing increasing the polishing effect is executed.

[0017]

The head 20 has a head 21 formed in a disk shape having a diameter slightly larger than the diameter of the workpiece 1 and a circular holding hole 22 with a fixed depth is concentrically embedded in the bottom surface of the head 21. The size of the holding hole 22 is formed so as to be slightly larger than the size of the workpiece 1. An air hole 23 is provided at the center of the holding hole 22 and a path 24 to be connected to a vacuum pump and an air pressure pump (not shown in the drawing) is connected to the air hole 23. A backing pad 25 in a disk shape having an outside diameter almost equal to the inside diameter of the holding hole 22 is concentrically arranged inside the holding hole 22 and adhered to a porous substrate 28 by an adhesive layer (not shown in the drawing). The backing pad 25 is formed by a foam of polyurethane and a very flexible layer of the porous foam is uniformly formed overall the surface in contact with the workpiece 1.

[0018]

A guide ring 26 in a circular ring shape is in contact with the periphery of the bottom surface of the head 21 and fixed to the head 21 with a plurality of bolts 27. For the guide ring 26, a resin having a hardness sufficiently lower than the hardness of the polished surface 7 of the workpiece 1 is used and the guide ring 26 is formed in a circular ring shape having an outside diameter equal to the outside diameter of the head 21 and an inside diameter almost equal to the inside diameter of the holding hole 22. The guide ring 26 holds the workpiece 1 so as to prevent the workpiece 1 from protruding outside during the polishing operation in the state that the polished surface 7 thereof is exposed downward from the lower end. The backing pad 25 is fit into the hollow of the guide ring 26.

[0019]

The head 20 is supported so as to freely rotate in a horizontal surface round the air hole 23. The head 20 is driven to rotate by a rotation drive unit (not shown in the drawing). The head 20 moves back and forth between the station where the polishing tool 11 is installed and a loading station (not shown in the drawing) for delivering workpieces 1 one by one by a transfer device (not shown in the drawing). The head 20 slightly moves down during the polishing operation.

[0020]

As shown in FIGS. 1A and 1B, in the backward location in the rotation direction (the direction of the arrow shown in the drawing) of the head 20 on the top surface of the polishing tool 11, a brushing device 30 is installed downward in the vertical direction. The brushing device 30 has a base plate 31 formed in a disk shape having a diameter slightly larger than the diameter of the workpiece 1 and the base plate 31 is supported so as to freely rotate in a horizontal surface. At the center of the top surface of the base plate 31, a rotational axis 32 arranged upward in the vertical direction is fixed and the base plate 31 is structured so as to be driven to rotate by the rotational axis 32. A brush 33 is uniformly implanted overall the bottom surface of the base plate 31.

[0021]

In the backward location in the rotation direction of the brushing device 30 on the top surface of the polishing tool 11, a cleaner 40 is installed downward in the vertical direction. The cleaner 40, as shown in FIG. 2, has a base 41 formed in a disk shape having a diameter slightly larger than the diameter of the workpiece 1 and the base 41 is horizontally fixed at a predetermined location of the top surface of the polishing tool 11. In the bottom surface of the base 41, a cleaning part 42 for cleaning a polishing tool is embedded and the cleaning part 42 is set so as to form a narrow space with a low height and a wide plane area between the bottom surface of the base 41 and the top surface of the polishing tool 11. At both ends of the cleaning part 42 in the diameter direction (hereinafter, referred to as the lateral direction), a nozzle 44 to which a cleaning water path 43 is connected and a vacuum hole 46 to which a vacuum path 45 is connected are installed respectively. The cleaning water path 43 is connected to a cleaning water supplier (not shown in the drawing) comprising a water source and a pump and structured so as to jet pressurized pure water from the nozzle 44 as cleaning water 47. The vacuum path 45 is connected to a vacuum device (not shown in the drawing) comprising a vacuum pump and others and structured so as to suck a cleaned objective 48 together with the cleaning water 47 jetted from the nozzle 44.

[0022]

A particle measurement device 49 for measuring the number of particles passing the vacuum path 45 is installed in the vacuum path 45 and the particle measurement device 49 is structured so as to send measured results to a controller (not shown in the drawing). The controller automatically controls the cleaner and slurry supplier on the basis of measured results as described later and is structured so as to decide the maintenance time and predict a trouble such as an occurrence of damage.

[0023]

On the bottom surface of the base 41, a low friction sheet 50 such as fluorocarbon resin is pasted and even if the cleaner 40 comes in contact with the polishing tool 11, the damage to the polishing tool 11 is reduced by the low friction sheet 50.

[0024]

In the backward location in the rotation direction of the cleaner 40 on the top surface of the polishing tool 11, an abrasive supplier 52 for supplying abrasives 51 to the polishing tool 11 is installed. The abrasive supplier 52 has a supply roller for supplying a tape 53 holding the abrasives 51, and one main surface of the tape 53 supplied from the supply roller 54 is pushed to the top surface of the polishing tool 11 by a pushing roller 55, and the abrasives 51 are transferred to the top surface of the polishing tool 11. When the abrasives 51 are transferred to the top surface of the polishing tool 11, the tape 53 is structured so as to be rewound by a rewinding roller 56. For the abrasives 51, particles of colloidal silica or cerium oxide are used. The particle diameter of colloidal silica is 20 nm to 50 nm and the particle diameter of cerium oxide is 0.5 $\mu$m to several $\mu$m. The tape 53 may be structured so that using a pressure-sensitive adhesive or static electricity for holding the abrasives 51 by the tape 53, transfer of the abrasives 51 to the polishing tool 11 is executed quickly and securely.

[0025]

In the backward location in the rotation direction of the abrasive supplier 52 on the top surface of the polishing tool 11, a pure water supplier 60 is structured so as to supply pure water 61 to the top surface of the polishing tool 11. As shown in FIG. 4, in this embodiment, a slurry supplier 63 for supplying slurry 62 in which the abrasives 51 are suspended in the pure water 61 to the face where there are abrasives 15 of the polishing tool 11 is structured by the abrasive supplier 52 and the pure water supplier 60.

[0026]

Next, the chemical mechanical polishing method which is an embodiment of the present invention will be explained using an example of a case that multi-layer interconnections are formed by referring to FIG. 7.

[0027]

Figure 7:
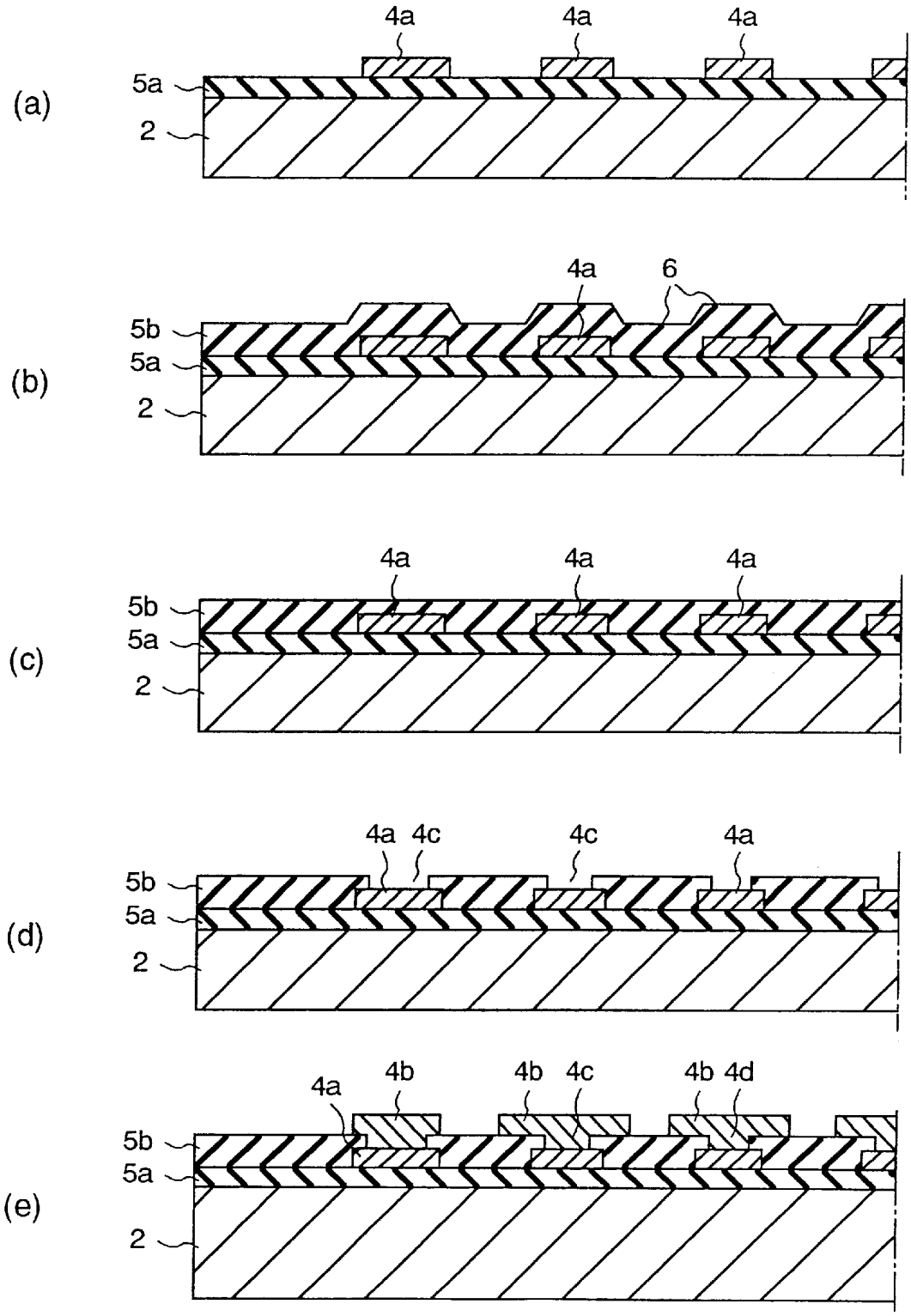
FIG. 7 shows enlarged partial cross sectional views for explaining the use method, to the manufacturing method of a semiconductor apparatus, for chemical mechanical polishing, and (a) shows a first interconnection forming step, (b) a second dielectric film forming step, (c) a flattening step, (d) a hole forming step, and (e) a second interconnection forming step.

As shown in FIG. 7(*a*), on the top surface side of a wafer 2, a first dielectric film 5*a* of the multi-layer interconnections is formed. Next, on the first dielectric film 5*a*, first interconnections 4*a* are patterned by the metal film deposition process, lithographic process, and etching process. The first interconnections 4*a* include word lines formed by polysilicone or silicides.

[0028]

Next, as shown in FIG. 7(*b*), on the first dielectric film 5*a* of the wafer 2, a second dielectric film 5*b* formed by $SiO_2$ or $Si_3N_4$ is deposited by the CVD method. The second dielectric film 5*b* covers the first interconnections 4*a*. Since convex parts corresponding to the thickness of the first interconnections 4*a* are formed on the top surface of the second dielectric film 5*b*, the polished surface 7 enters the state that many and unspecified concave and convex parts 6 are formed on it. The wafer in this state is supplied to the polishing machine 10 in this embodiment as a workpiece 1.

[0029]

On the other hand, in the polishing machine 10, the rotational speed by the rotational axis 13 of the polishing tool 11 is stabilized, the pushing roller 55 of the abrasive supplier 52 is pushed to the top surface of the polishing tool 11 and the abrasives 51 held by the tape 53 are transferred to the face where there are abrasives 15 of the polishing tool 11. The abrasives 51 are uniformly pasted overall the face where there are abrasives 15 of the polishing tool 11.

[0030]

At the same time, the pure water 61 is uniformly sprayed in the area of the face where there are abrasives 15 on the polishing tool 11 where the abrasives 51 are pasted by the pure water supplier 60. By supply of the abrasives 51 and the pure water 61, the face where there are abrasives 15 uniformly holding the fresh slurry 62 of the abrasives 51 free of foreign substances overall is formed on the top surface of the polishing tool 11, so that a state that the face where there are abrasives 15 which can execute the chemical mechanical polishing which will not damage the polished surface of the workpiece 1 at a stable polishing rate is formed is realized.

[0031]

The workpiece 1 supplied to the polishing machine 10, as shown in FIG. 3, is inserted into the guide ring 26 of the head 20 with the polished surface 7 side down. When the workpiece 1 is inserted into the guide ring 26, a negative pressure is supplied to the air hole 23 via the vacuum path 24. The negative pressure is applied to the surface 8 of the workpiece 1 on the opposite side of the polished surface 7 (hereinafter referred to as the bottom surface) via the backing pad 25, so that the workpiece 1 is vacuum-absorbed to the head 20. The head 20 vacuum-adsorbing the workpiece 1 is transferred right above the polishing tool 11 by the transfer device and then moved down and hence the polished surface 7 of the workpiece 1 is pushed to the face where there are abrasives 15 of the polishing cloth 14.

[0032]

As the head 20 moves down, the workpiece 1 is vertically pressed by the head 21 via the backing pad 25, so that the polished surface 7 of the workpiece 1 is rubbed by the face where there are abrasives 15 in the state that the polished surface 7 is pressed against the face where there are abrasives 15 of the polishing cloth 14 by mechanical force by the head 21. To improve the processing uniformity, compressed air may be supplied to the bottom surface of the workpiece 1. Since the slurry 62 is supplied to the face where there are abrasives 15 at the same time, in addition to the mechanical polishing, the chemical mechanical polishing improving the polishing effect thereof is executed. Since the polished surface 7 is subjected to chemical mechanical polishing by the face where there are abrasives 15 and the slurry 62 in the state that the workpiece 1 is pressed against the face where there are abrasives 15 by mechanical force by the head 20, the polishing amount of the polished surface 7 by the face where there are abrasives 15 is uniform overall the surface.

[0033]

Since the surface of the second dielectric film 5*b* constituting the polished surface 7 is uniformly polished overall it, as shown in FIG. 7(*c*), the concave and convex parts 6 are overall removed, and the second dielectric film 5*b* having a uniform thickness overall the surface is formed, and extremely satisfactory flattening is realized. In the chemical mechanical polishing, the convex parts of the concave and convex parts 6 formed on the second dielectric film 5*b* which is the polished surface 7 of the workpiece 1 are removed first and the surface of the second dielectric film 5*b* is gradually flattened. In this case, the polished surface 7 is uniformly polished overall it, so that the thickness of the second dielectric film 5*b* positioned on the polished surface 7 is uniformly reduced overall the surface. Since the second dielectric film 5*b* is uniformly deposited overall the surface, if the polishing amount is uniform overall the surface, the thickness of the second dielectric film 5*b* positioned on the polished surface 7 after polishing is uniform overall the surface. Therefore, when the polishing amount by the polishing machine 10 is appropriately set according to the relationship between the thickness of the second dielectric film 5*b* before polishing, the thickness of the first interconnections 4*a*, and the concave and convex parts 6, the second dielectric film 5*b* can be flattened without polishing the first interconnections 4*a*.

[0034]

Figure 6:
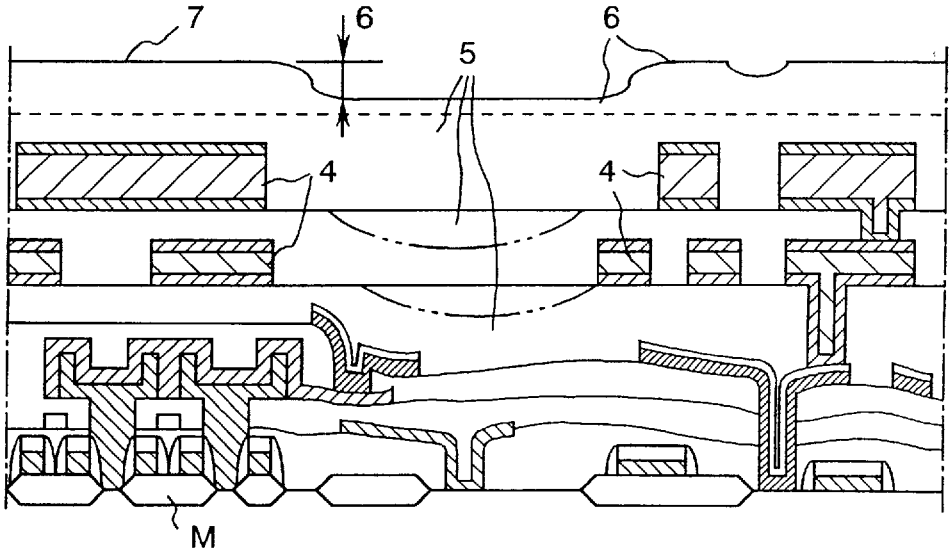
FIG. 6 is an enlarged partial cross sectional view of the workpiece shown in FIG. 5.

When the aforementioned chemical mechanical polishing is executed, foreign substances such as clustered particles generated by clustering of the abrasives 15 in the slurry, chips generated during polishing, and broken pieces and dust generated by crushing of a wafer remain on the face where there are abrasives 15 of the polishing tool 11. The remaining clustered particles and foreign substances cause damage to the polished surface 7 of the workpiece 1 during the chemical mechanical polishing. As shown in FIG. 6, when the polished surface 7 of the workpiece 1 is damaged, the dielectric layers are short-circuited or the first interconnections 4*a* which are the first pattern are damaged and hence the resistance reduces or the interconnections are disconnected. Namely, when clustered particles and foreign substances remain on the face where there are abrasives 15 of the polishing tool 11, reliable chemical mechanical polishing cannot be executed stably.

[0035]

Therefore, this embodiment is structured so as to remove all clustered particles and foreign substances by sequentially arranging the brushing device 30 and the cleaner 40 in the backward location in the rotational direction of the polishing tool 11 of the head 20. Namely, in the brushing device 30, the face where there are abrasives 15 of the polishing tool 11 is brushed by the brush 33 and hence clustered particles and foreign substances dug into the face where there are abrasives 15 are raked out.

[0036]

In the cleaner 40, the cleaning water 47 supplied from the cleaning water path 43 is jetted into the narrow space of the cleaning part 42 from the nozzle 44. On the other hand, the cleaning part 42 is sucked by the negative pressure applied to the vacuum hole 46 from the vacuum path 45, so that the cleaning water 47 jetted into the space of the cleaning part 42 flows overall the cleaning part 42 and then is all collected into the vacuum hole 46. Since the cleaning water 47 jetted into the cleaning part 42 is jetted into a narrow space, it does not become a laminar flow but enters the turbulent flow state. Therefore, clustered particles and foreign substances raked out by the brushing device 30 on the face where there are abrasives 15 of the polishing tool 11 are taken away from the face where there are abrasives 15 very effectively by the cleaning water 47 in the turbulent flow state and enter the floating state. Cleaned objectives 48 of clustered particles and foreign substances which are peeled off from the face where there are abrasives 15 and floating are all collected into the vacuum hole 46 accompanying the cleaning water 47 in the turbulant flow state.

[0037]

As mentioned above, according to this embodiment, clustered particles and foreign substances generated by chemical mechanical polishing are fully removed by the brushing device 30 and the cleaner 40 arranged in the backward location in the rotational direction of the head 20, so that an occurrence of damage of the polished surface 7 of the workpiece 1 caused by these clustered particles and foreign substances can be prevented and an occurrence of damage of the first interconnections 4*a* caused by the aforementioned damage can be prevented.

[0038]

When cleaning of the face where there are abrasives 15 of the polishing tool 11 is powerfully executed by the cleaner 40, a state that the slurry 62 supplied to the face where there are abrasives 15 is also removed is generated. In this embodiment, by the abrasive supplier 52 and the pure water supplier 60 arranged in the backward location in the rotational direction of the cleaner 40, as mentioned above, the abrasives 51 and the pure water 61 are sequentially supplied, so that fresh slurry 62 is newly supplied to the face where there are abrasives 15 of the polishing tool 11.

[0039]

In this case, on the basis of the measured data of particles passing the vacuum path 45 by the particle measurement device 49 installed in the vacuum path 45 of the cleaner 40, the relationship between the cleaning condition of the face where there are abrasives 15 of the polishing tool 11 by the cleaner 40 and the supply condition of slurry 62 by the abrasive supplier 52 and the pure water supplier 60 is monitored and hence the operation conditions of the cleaner 40, the abrasive supplier 52, and the pure water supplier 60 are automatically controlled optimally. Furthermore, on the basis of the measured data of particles, the maintenance time is decided and a trouble such as an occurrence of damage of a workpiece is predicted.

[0040]

In this case, by storing the standard condition as a standard value for measured data of the particle measurement device 49 and monitoring the shift condition from the standard value, the operation condition can be automatically controlled. The standard condition means numerical value data such as the particle diameter distribution, density (the number of particles), and others of ejected particles when the chemical mechanical polishing is appropriately executed and the shift condition means the chemical mechanical polishing condition, for example, when the mean value of particle diameter distribution varies every 10%. When such each condition is learned beforehand and it reaches a certain rate, the sequence can be controlled. The sequence may be programmed so as to issue a warning by a means for ringing an alarm when a certain point of time comes.

[0041]

When the chemical mechanical polishing in the preset polishing amount ends, the surface of the second dielectric film 5*b* which is the polished surface 7 of the workpiece 1 is flattened with extremely high precision as shown in FIG. 7(*c*) and right above the first interconnections 4*a*, the second dielectric film 5*b* remains with the preset layer thickness.

[0042]

The workpiece 1 in this state is stored in the wafer cassette from the polishing machine 10 by the unloading device and sent to the hole forming step via the subsequent cleaning step. At the hole forming step, right above the predetermined first interconnections 4*a* of the second dielectric film 5*b* of the workpiece 1, through holes 4*c* are made as shown in FIG. 7(*d*).

[0043]

Next, at the second interconnection forming step, the second interconnections 4*b* are patterned on the second dielectric film 5*b* as shown in FIG. 7(*e*) by the metal film deposition process, lithography process, and etching process. In this case, since the surface of the second dielectric film 5*b* is flattened with high precision, the second interconnections 4*b* are patterned with extremely high precision. During patterning of the second interconnections 4*b*, a part of the metal film deposited on the second dielectric film 5*b* is filled in the through holes 4*c* made in the second dielectric film 5*b*. By the metal parts filled in the through holes 4*c*, through hole conductors 4*d* are formed. The predetermined patterned parts of the second interconnections 4*b* are electrically connected to the first interconnections 4*a* with the through hole conductors 4*d*.

[0044]

Hereafter, the aforementioned dielectric film forming step, flattening step, hole forming step, and interconnection forming step are repeated and the multi-layer interconnections shown in FIG. 6 are formed. In this case, the dielectric film and interconnections of the layer formed at the previous step correspond to the dielectric film and interconnections of the lower layer at the next step. Holes are not limited to through holes but contact holes are also included. Holes not only connect the interconnections of the first layer to the interconnections of the second layer but also connect the interconnections of the first layer to the interconnections of the third layer or fourth layer.

[0045]

The following effects can be obtained by the aforementioned embodiment.

[0046]

(1) When the brushing device and cleaner are sequentially installed in the backward location in the rotational direction of the polishing tool of the head 20 which executes chemical mechanical polishing, clustered particles and foreign substances generated by the chemical mechanical polishing are fully removed by the brushing device and cleaner, so that an occurrence of damage of the polished surface of a workpiece caused by these clustered particles and foreign substances can be prevented and as a result, an occurrence of damage of the base pattern caused by the aforementioned damage can be prevented.

[0047]

(2) By doing Item (1), reliable chemical mechanical polishing can be executed stably.

[0048]

(3) When the brushing device is arranged on the upstream side of the cleaner, the face where there are abrasives of the polishing tool is brushed by the brush of the brushing device and clustered particles and foreign substances dug into the face where there are abrasives can be raked out beforehand, so that clustered particles and foreign substances can be securely removed by the cleaner.

[0049]

(4) In the cleaner, by jetting cleaning water into the narrow cleaning part and sucking the cleaning part, it is possible to take away clustered particles and foreign substances on the face where there are abrasives of the polishing tool from the face where there are abrasives very effectively and let them float by cleaning water in the turbulent flow state. Therefore, cleaned objectives of clustered particles and foreign substances can be all collected into the vacuum hole accompanying cleaning water in the turbulent flow state.

[0050]

(5) Since it is possible to collect slurry by the cleaner and reuse it, waste of very expensive slurry can be reduced and the cost can be reduced.

[0051]

(6) By arranging the abrasive supplier and pure water supplier in the backward location in the rotational direction of the cleaner, abrasives and pure water can be supplied by the abrasive supplier and pure water supplier, so that fresh slurry can be newly formed always on the face where there are abrasives of the polishing tool and the effect of Item (2) can be increased much more.

[0052]

(7) By installing the particle measurement device in the vacuum path of the cleaner, on the basis of the measured data of particles passing the vacuum path by the particle measurement device, the relationship between the cleaning condition of the face where there are abrasives of the polishing tool by the cleaner and the supply condition of slurry by the abrasive supplier and pure water supplier can be monitored. Therefore, the operation conditions of the cleaner, abrasive supplier, and pure water supplier are automatically controlled optimally and furthermore, it is possible to decide the maintenance time and predict a trouble such as an occurrence of damage of a workpiece on the basis of the measured data of particles.

[0053]

The invention made by the inventor has been concretely explained above according to the embodiments. However, the present invention is not limited to the aforementioned embodiments and needless to say, the embodiments can be can changed variously unless the argument is deviant.

[0054]

For example, the face where there are abrasives of a polishing tool may be formed not only by polishing cloth but also by a hard polishing pad and instead of polishing cloth or a polishing pad, it is possible to form the face by the surface of a polishing tool with abrasives fixed on which is disclosed in International Patent Application WO97/10613 mentioned above. When a polishing tool with abrasives fixed on is used, damage by a large foreign substance caused by chipping can be prevented and the abrasive supplier and pure water supplier can be omitted.

[0055]

The supply of slurry may be structured not only so as to be executed by the abrasive supplier and pure water supplier but also so as to spray slurry to the face where there are abrasives of the polishing tool by a sprayer.

[0056]

The brushing device and cleaner may be not only separately structured but also integratedly structured and when they are integratedly structured, the space can be saved.

[0057]

As cleaning water of the cleaner, not only pure water but also a solution mixed with a surface active agent may be used. When a solution mixed with a surface active agent is used, clustered abrasives can be dispersed, so that the cleaning efficiency can be increased.

What is claimed is:

1. A polishing method comprising the step of:

pressing and polishing a surface of a workpiece against a face of a polishing tool, said face containing abrasives;

while or before said workpiece is pressed against said polishing tool, spraying cleaning water to said face;

sucking said cleaning water, after being sprayed to said face, by a vacuum; and collecting the sprayed water via a vacuum hole.

2. A polishing method according to claim 1, wherein before said cleaning water is sprayed to said face where there are abrasives of said polishing tool and also sucked by said vacuum hole, said face where there are abrasives of said polishing tool is mechanically brushed by a brush.

3. A polishing method according to claim 1, wherein after said cleaning water is sprayed to said face where there are abrasives of said polishing tool and also sucked by said vacuum, slurry is supplied to said face where there are abrasives of said polishing tool.

4. A polishing method according to claim 1, wherein a cleaning tool is provided adjacent said face, the cleaning tool having a nozzle and the vacuum hole, and wherein the cleaning water is sprayed via the nozzle.

5. A polishing method according to claim 4 wherein the nozzle and the vacuum hole are located at opposite ends of the cleaning tool.

6. A polishing method according to claim 1, wherein the sprayed cleaning water is a pressurized jet of pure water.

7. A polishing method according to claim 1, wherein prior to spraying the water the face has thereon objects to be cleaned from the face, and wherein said objects are sucked by the vacuum and collected via the vacuum hole with the cleaning water sucked by the vacuum and collected via the vacuum hole.

8. A polishing method according to claim 1, wherein the sprayed cleaning water flows in turbulent flow.

9. A polishing method according to claim 1, wherein said cleaning water, is sucked by the vacuum at said face.

10. A polishing method according to claim 1, wherein said workpiece is a semiconductor wafer.

11. A polishing method according to claim 10, wherein a main surface of said semiconductor wafer has a dielectric film thereon, and a surface of said dielectric film is polished.

12. A polishing method according to claim 11, wherein said dielectric film is made of a material selected from the group consisting of $SiO_2$, and $Si_3N_4$.

13. A polishing machine for pressing and polishing a surface of a workpiece to be polished against a face of a polishing tool, said face containing abrasives thereon, comprising:

a cleaner, for spraying cleaning water to said face containing said abrasives and for sucking the cleaning water by a vacuum and for collecting said cleaning water via a vacuum hole, arranged behind a location where said workpiece is pressed against said polishing tool in a rotational direction of said polishing tool.

14. A polishing machine according to claim 13, wherein the cleaner has a nozzle and said vacuum hole, and wherein the cleaning water is sprayed to said face via said nozzle.

15. A polishing machine according to claim 13, wherein the cleaner includes a bottom surface facing said face, and a sheet of a low friction material is provided on said bottom surface, between said bottom surface and said face.

16. A polishing machine according to claim 15, wherein said low friction material is a fluorocarbon resin.

17. A polishing machine for pressing and polishing a surface of a workpiece to be polished against a face of a polishing tool, said face containing abrasives thereon, comprising:

a cleaner, for spraying cleaning water to said face containing said abrasives and for sucking the cleaning water by a vacuum and for collecting said cleaning water via a vacuum hole, arranged behind a location where said workpiece is pressed against said polishing tool in a rotational direction of said polishing tool, and said polishing machine has a particle measurement device for measuring particles sucked on a vacuum hole side of said cleaner.

18. A polishing machine according to claim 17, wherein pure water is used as said cleaning water.

19. A polishing machine according to claim 17, wherein a solution mixed with a surface active agent is used as said cleaning water.

20. A polishing machine according to claim 17, wherein a brushing device for mechanically brushing said face where there are abrasives of said polishing tool by a brush is arranged on the upstream side of said cleaner.

21. A polishing machine according to claim 17, wherein a slurry supplier for supplying slurry to said face where there are abrasives of said polishing tool is arranged on the downstream side of said cleaner.

22. A polishing machine according to claim 21, wherein said slurry supplier has an abrasive supplier for supplying abrasives to said face where there are abrasives and a solution supplier for supplying a solution to said face where there are abrasives.

* * * * *